United States Patent [19]

Brodeur et al.

[11] Patent Number: 4,545,304

[45] Date of Patent: Oct. 8, 1985

[54] ARTICULATED RAILROAD CAR

[76] Inventors: Rene H. Brodeur, 2108 Beechwood Ave., Wilmette, Ill. 60091; Boris S. Terlecky, 234 Lippincott La., Fox Lake, Ill. 60020

[21] Appl. No.: 719,048

[22] Filed: Apr. 4, 1985

Related U.S. Application Data

[63] Continuation of Ser. No. 409,844, Aug. 20, 1982, abandoned.

[51] Int. Cl.[4] ..... B61D 17/00; B61G 9/20

[52] U.S. Cl. ..... 105/3; 213/58; 213/62 R; 213/69; 213/72

[58] Field of Search ..... 105/3; 213/50, 58–60, 213/62 R, 62 A, 64, 69, 72, 73

[56] References Cited

U.S. PATENT DOCUMENTS

| | | | |
|---|---|---|---|
| Re. 29,011 | 10/1976 | Altherr | 213/64 |
| 87,158 | 2/1869 | Fairlie | 213/73 |
| 385,027 | 6/1888 | Ward et al. | 213/96 |
| 997,421 | 7/1911 | Shallenberger et al. | 213/50 |
| 1,142,358 | 6/1915 | O'Connor | 213/54 |
| 1,825,696 | 10/1931 | Kadel et al. | 213/50 |
| 2,545,330 | 3/1951 | Wolfe | 213/58 X |
| 3,564,766 | 2/1971 | Edwards et al. | 213/75 TC |
| 3,709,376 | 1/1973 | Altherr | 213/62 R |
| 4,339,996 | 7/1982 | Brodeur et al. | 105/3 |
| 4,422,557 | 12/1983 | Altherr | 213/62 R |

FOREIGN PATENT DOCUMENTS

| | | | |
|---|---|---|---|
| 1455233 | 5/1969 | Fed. Rep. of Germany | 213/64 |

*Primary Examiner*—Randolph A. Reese

*Attorney, Agent, or Firm*—Haight, Hofeldt, Davis & Jambor

[57] ABSTRACT

An articulated railroad car including a plurality of platforms each supported by a single axle wheel truck at each end. The platforms are connected to rigid drawbars which allow relative motion therebetween in both horizontal and vertical directions. The drawbars and the platforms have cooperable surfaces which engage when the car is being pushed and tend to align the platforms and drawbars to prevent jackknifing and derailment.

14 Claims, 14 Drawing Figures

ARTICULATED RAILROAD CAR

This application is a continuation of application Ser. No. 06/409,844, filed Aug. 20, 1982, now abandoned.

BACKGROUND OF THE INVENTION

This invention relates to railroad cars and more particularly to articulated railroad cars for transporting wheeled vehicular trailers. The present invention finds use in transporting truck trailers in "piggyback" fashion to destinations close to the ultimate delivery destination of the trailer contents. At that point, the truck trailers are lifted off the railroad cars and hitched to tractors for ultimate delivery of the goods.

It is desirable to be able to transport more than one truck trailer on each car in order to establish economical freight rates which will induce truckers and trucking companies to use railroad facilities rather than highways. To this end, the railroad cars may be articulated, i.e., constructed of two or more platforms or decks connected at a joint which allows relative movement between the decks. Not only must the decks be able to pivot or shift relative to one another in a horizontal plane to negotiate curves, but also the connecting joint should accommodate decks at different relative heights such as when one deck is loaded with a trailer and the adjacent deck is not.

Railroad cars are customarily supported by wheel trucks at their forward and rearward ends. In many of the large railroad car constructions, each wheel truck includes a supporting frame and two wheels mounted on each of two parallel axles, commonly referred to as a double axle wheel truck. In an articulated car, it is desirable that each deck be supported at its forward and rearward end so that the decks can be separated for repair and maintenance, and are self supporting. To help reduce costs, it would be desirable to use single axle wheel trucks which include only two wheels and one axle rather than the double axle wheel trucks described above. One of the problems which arises with single axle wheel trucks is their inability to withstand the forces imposed upon them and maintain the car on the track. This is especially true when the cars are skewed and are being pushed, for in that mode forces on the rail cars tend to cause the articulated car decks to jackknife and the car to derail.

Accordingly, it would be desirable to provide an articulated railroad car which includes a plurality of articuated decks each supported by a single axle wheel truck at its forward and rearward end and which can pivot or shift relative to one another in both horizontal and vertical directions. In addition, it would be desirable that the connection between the decks tend to correct skewing therebetween when the car is being pushed thereby minimizing the likelihood that the decks will jackknife.

SUMMARY OF THE INVENTION

The present invention overcomes the problems and disadvantages described above by providing a low-cost articulated railroad car having a semi-permanent connection between adjacent decks and which has single axle wheel trucks at the forward and rearward ends of each deck so that the decks can be separated for repair and maintenance and are self supporting. The connection between adjacent decks allows the decks to move relative to one another in both horizontal and vertical directions and is constructed to resist skewing and to reduce the likelihood of jackknifing when the car is being pushed. The construction of this invention minimizes the cost of the railroad car and yet provides for reliable, safe and efficient operation.

Additional objects and advantages of the present invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the articulated railroad car of the invention comprises at least two decks having forward and rearward ends, a truck at the forward and rearward end of each deck, the trucks including only two wheels joined by a single axle and a frame supporting the deck, disengageable couplings at the forward end of the first one of the decks and at the rearward end of the last of the decks, respectively, and a semipermanent coupling connecting the rearward end of one of the decks to the forward end of an adjacent deck, the coupling including a rigid drawbar engageable with means at the rearward end of the one deck and at the forward end of the adjacent deck to transmit pushing and pulling forces therebetween, the drawbar allowing relative movement between the decks in both horizontal and vertical directions.

In another aspect, the present invention relates to an articulated rail car which includes at least two decks having wheel trucks at the forward and rearward ends of each deck, and relates to the improvement which comprises a rigid drawbar interconnecting the rearward end of one of the decks and the forward end of an adjacent deck to transmit pushing and pulling forces therebetween, the drawbar and the decks being formed with means allowing relative movement between the decks and having cooperable and engageable surfaces which are operable to resist skewing of the decks when the car is being pushed.

The accompanying drawings which are incorporated in and constitute a part of this specification, illustrate two embodiments of the invention and, together with the description, serve to explain the principles of the invention.

DESCRIPTION OF THE PREFERRED EMBODIMENTS

Reference now will be made in detail to the present preferred embodiments of the invention, examples of which are illustrated in the accompanying drawings.

Figure 1:
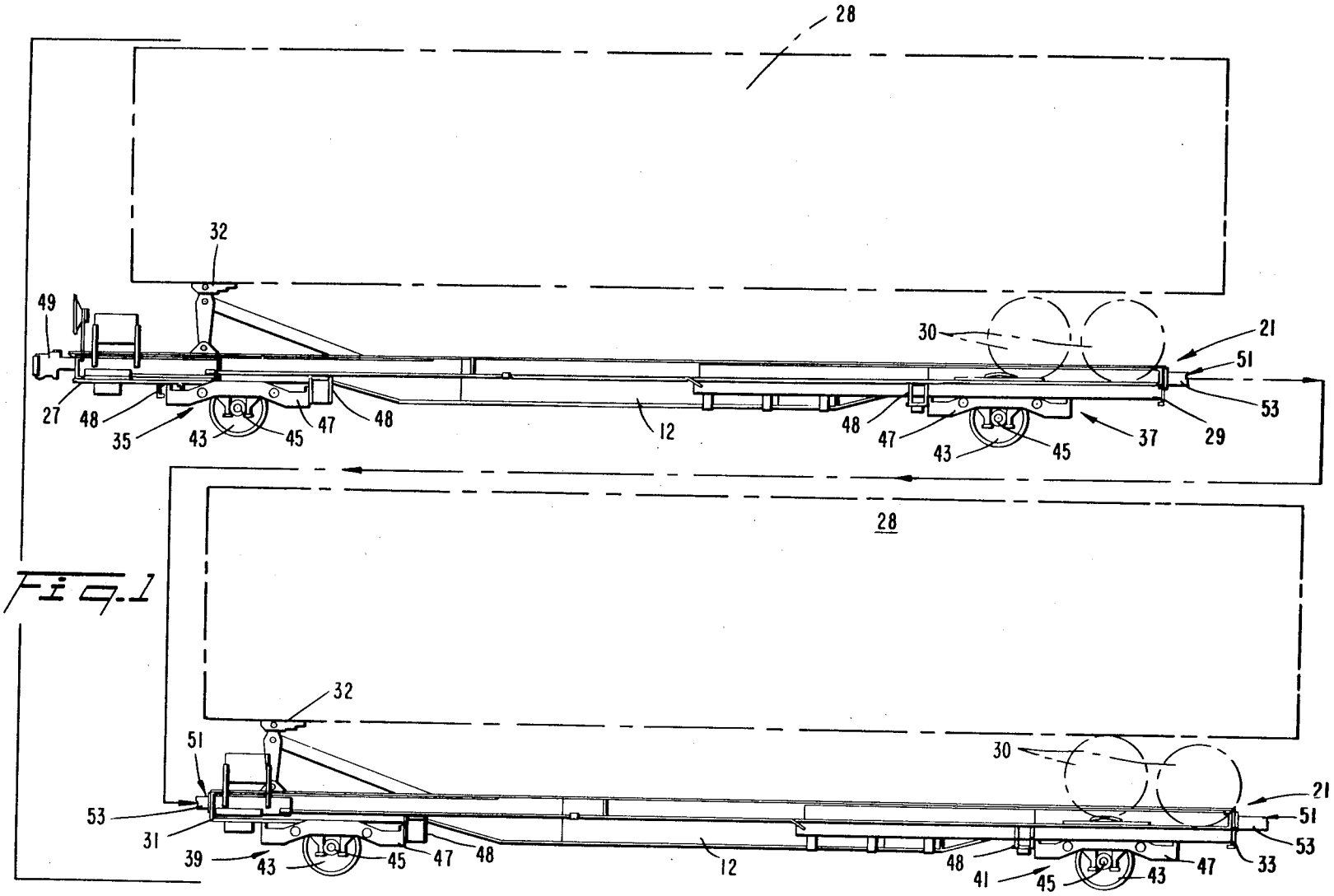
FIG. 1 is a side elevational view of an articulated railroad car constructed in accordance with the present invention.

The preferred embodiment of articulated railroad car is shown in FIG. 1 and is represented generally by the numeral 21. As embodied herein, the articulated railroad car 21 includes at least two platforms or decks 23, 25. These decks may be constructed, for example, as illustrated in U.S. Pat. No. 4,339,996, with central spines 12 forming the main longitudinal structural component of each platform. The disclosure of U.S. Pat. No. 4,339,996 is hereby incorporated by reference herein. The particular construction of the decks is considered to be lightweight and fuel efficient.

Deck 23 has a forward end 27 and a rearward end 29. Deck 25 has a forward end 31 and a rearward end 33. Each of the decks 23, 25 is adapted to support a truck trailer which includes a body 28 having wheels 30 at one end. The other end of the trailer is supported by a fifth wheel assembly 32.

In accordance with the invention, a wheel truck is provided at the forward and the rearward end of each deck, the trucks including only two wheels joined by a single axle and a frame supporting the deck. As embodied herein, wheel trucks 35, 37 are provided at the forward and rearward end, respectively of the deck 23. Similarly, wheel trucks 39, 41 are provided at the forward and rearward end, respectively, of deck 25. The wheel trucks are substantially identical and each includes only two wheels 43 (only one of which is shown) joined by a single axle 45, and a frame 47 suitably connected to the associated central spine through appropriate means 48. Suitable trucks and the manner of connection between the platform and truck are also illustrated in said U.S. Pat. No. 4,339,996. These particular features, however, form no part of the present invention.

A disengageable coupling 49 is provided at the forward end of the first deck 23. A similar disengageable coupling (not shown) is provided at the rear most deck forming the articulated railroad car 21. In the embodiment shown, there are at least three decks making up the railroad car, and usually four, with a coupler 49 at the front of the first and the rear of the fourth.

It will be appreciated that by providing a wheel truck at each end of the decks 23, 25, they are self supporting and can be separated from one another for repair and maintenance. It will further be appreciated that the wheel trucks include only two wheels joined by a single axle which makes the railroad car 21 considerably less expensive than one using the more conventional double axle wheel trucks.

In accordance with the invention, a semi-permanent coupling connects the rearward end of one of the decks to the forward end of an adjacent deck. The semi-permanent coupling includes a rigid drawbar engageable with means at the rearward end of the one deck and at the forward end of the adjacent deck to transmit pushing and pulling forces therebetween.

As embodied herein, the semi-permanent coupling assembly is illustrated generally at 51 and is seen to include a rigid drawbar 53 which connects the rearward end 29 of deck 23 to the forward end 31 of deck 25. Another coupling 51 at the rear end of deck 25 connects it to another deck (not shown), and if four decks are utilized, another drawbar connects the rearward end of the third deck to the forward end of the fourth deck.

Figure 2:
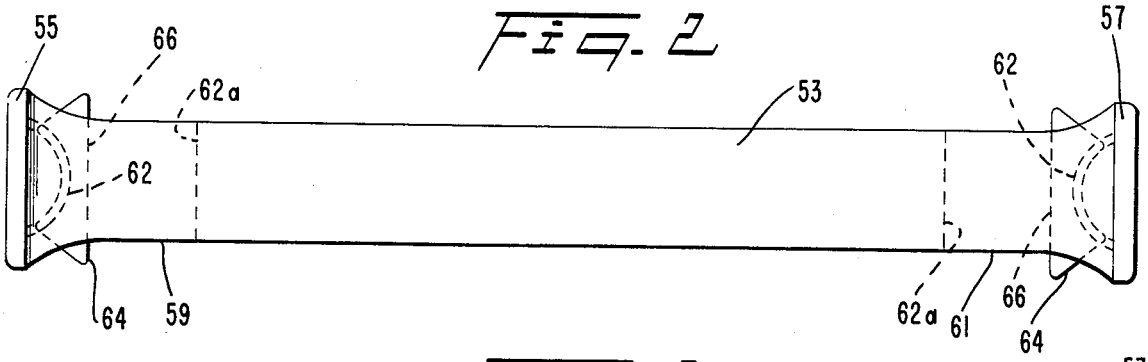
FIG. 2 is a top plan view of a drawbar of the present invention.
Figure 3:
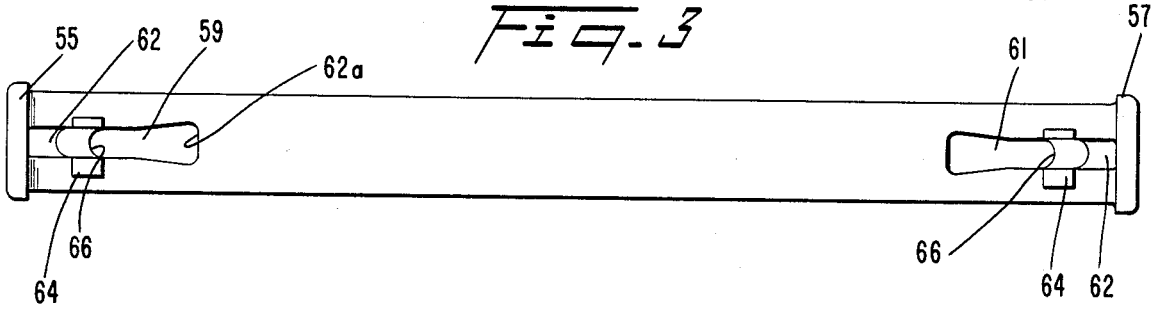
FIG. 3 is a side elevational view of the structure of FIG. 2.

As shown more clearly in FIGS. 2 and 3, the drawbar 53 is an elongated metal bar which includes enlarged flat flanges 55, 57 at opposite ends and keyhole shaped slots 59, 61 adjacent the flanges 55, 57, respectively.

Figure 4:
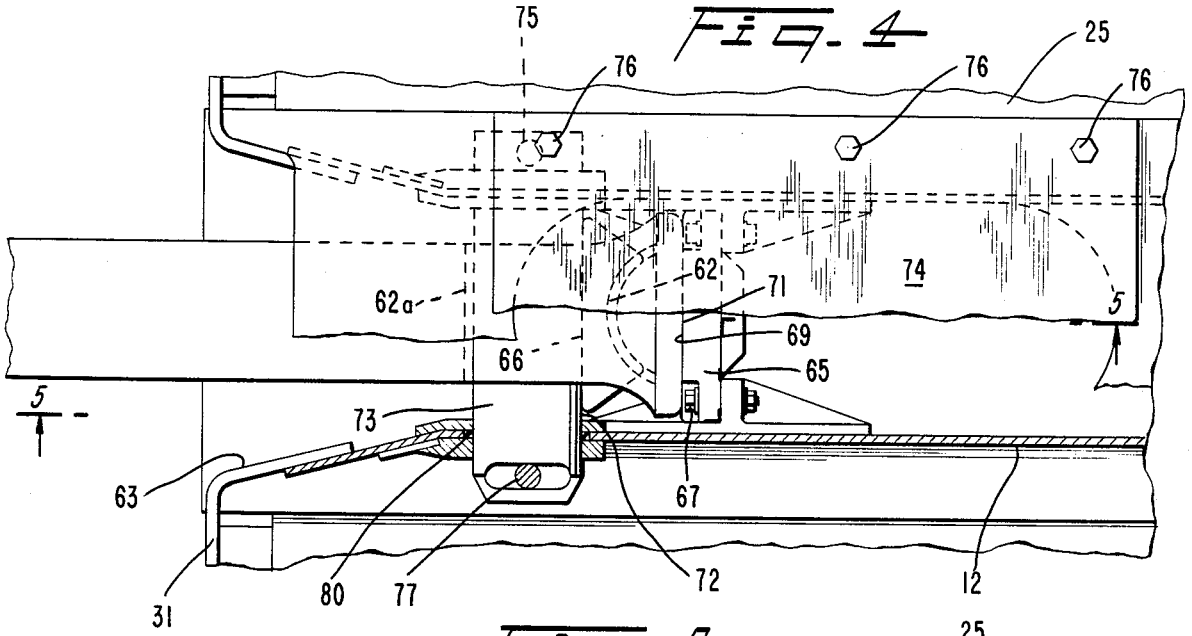
FIG. 4 is an enlarged view, partly in section, of a portion of car of FIG. 1.

As best seen in FIGS. 2 and 4, surfaces 62 which define the walls of the openings 59, 61 adjacent the flanges 55, 57 are arcuate in the horizontal plane. Separate bearing blocks 64 are disposed in the slots which are adapted to slidably pivot upon surfaces 62. These bearing blocks include longitudinal surfaces 66 which extend transversely of the slots 59, 61.

Figure 5:
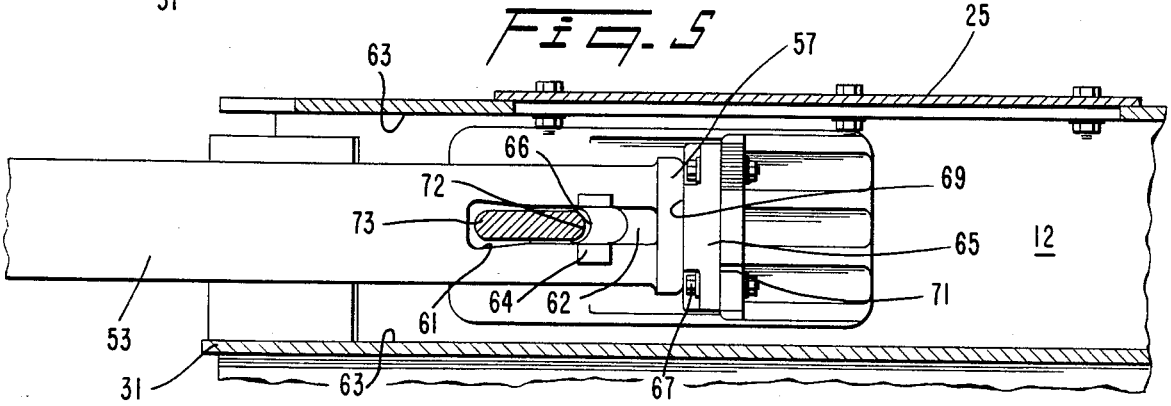
FIG. 5 is an enlarged sectional view of the structure of FIG. 4 taken, along the lines 5—5 thereof.
Figure 6:
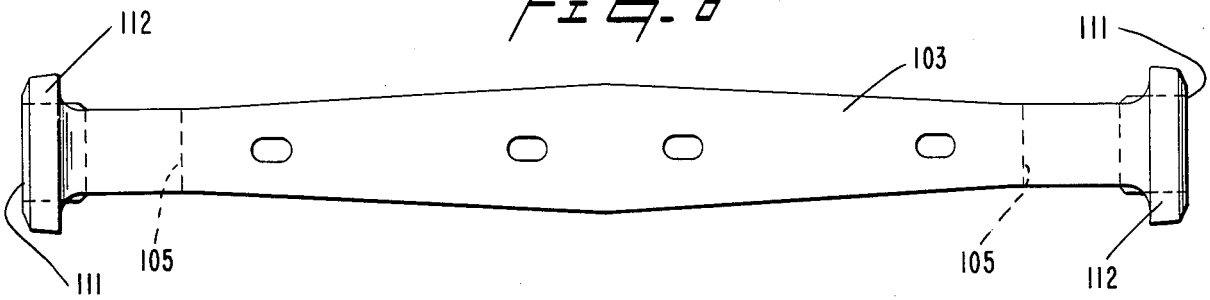
FIG. 6 is a view similar to FIG. 2 showing a modified form of drawbar of the present invention.
Figure 7:
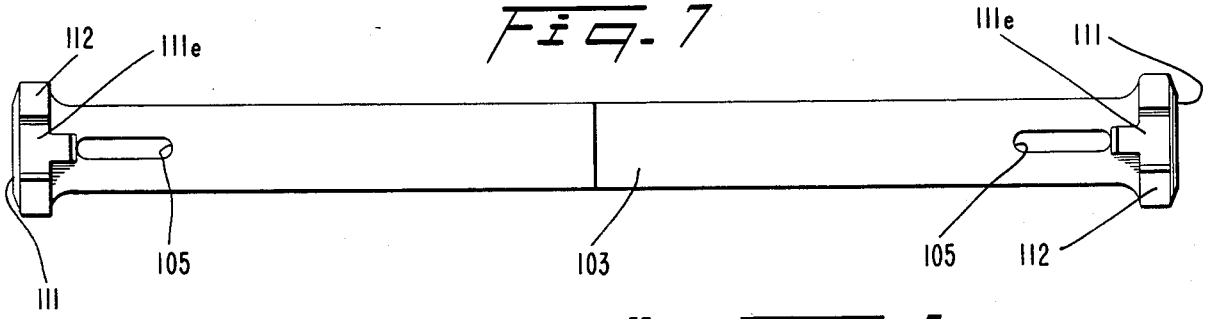
FIG. 7 is a side elevational view of the structure of FIG. 6.
Figure 10:
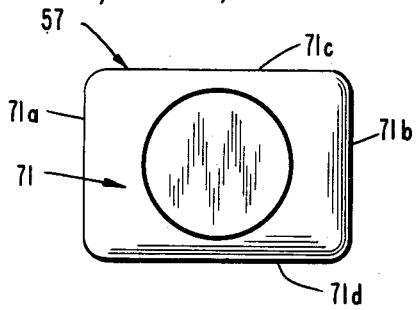
FIG. 10 is an end view of the drawbar of FIGS. 2 and 3.

The connection between the drawbar 53 and the decks 23, 25 is identical. As shown in FIGS. 4 and 5, the drawbar 53 extends into a tapered aperture 63 formed in the deck end 31 with the flange 57 positioned adjacent a rigid stop block 65 fixed to the deck 25 by bolts 67. The stop block 65 has a substantially flat face 69 which confronts a flat face 71 on the drawbar 57. When the platform 23, 25 and drawbar 53 are in alignment, these faces are parallel to each other and in face-to-face contact. The flat surface 71 is defined by two vertical edges 71*a*, 71*b* and two horizontal edges 71*c*, 71*d*. (See FIG. 10).

A coupler or draft key 73, which is fixed to each platform 23, 25, by bolts 75, 77, extends through the keyhole shaped openings 59, 61 in the bar 53, with one longitudinal edge or surface 72 adapted for contact with longitudinal surfaces 66 of blocks 64 in slots 59, 61. The opening 61 is larger than the key 73, as shown in FIGS. 4 and 5, to allow horizontal motion between the bar 53 and the deck 25. This is accommodated by sliding action of blocks 64 on surfaces 62.

When the car 21 is being pulled, the blocks 64 of drawbar 53 engage the keys 73 at surfaces 66, 72 and the drawbar is in tension. When the car 21 is being pushed, the surfaces 71, 69 on the drawbar flanges 55, 57 and stop blocks 65, respectively, engage and the drawbar 53 is in compression. Thus, the drawbar transmits both pushing and pulling forces between the decks 23, 25.

Typically, bolts 75, 77 do not carry draft or tension loads when the cars are being pulled. The draft key 73 passes through slots 80 in central spine 12 and transmits tension forces directly from the central spine 12 of one car to the central spine 12 of the adjacent car.

The aperture 63 is covered by a plate 74 secured in place by bolts 76. Thus, by removing the plate 74, the bolts 75, 77 may be removed and the draft key 73 can also be removed and the coupling 51 disassembled from the platforms 23, 25.

In accordance with the invention, the drawbar allows relative movement between the decks in both horizontal and vertical directions. As embodied herein and shown in FIG. 4, the longitudinal dimension between surface 66 of blocks 64 and the opposite surface 62*a* of slots 59, 61 is larger than the width dimension of the coupler pin 73 so that the blocks 64 can slide on surfaces 62 and permit drawbar 53 to pivot relative to the decks 23, 25 in the plane of FIG. 4. This allows the decks 23, 25 to pivot in the horizontal direction relative to one another allowing the car 21 to better negotiate curves.

The keyhole shaped openings 59, 61 are flared outwardly at one end, as shown in FIG. 5, so that the drawbar 53 can pivot or rock relative to the deck 25 substantially in the plane of FIG. 5. Also, key 73 is permitted some pivotal movement within slots 80 in central spine 12. This allows relative movement between the decks 23, 25 in the vertical direction such as when one is loaded with a truck trailer and the other is not causing the decks to be at different heights.

When the above-described pivotal action takes place during buff or pushing of the cars, the drawbar end flanges 55, 57 operate to impose corrective forces and urge the platforms into alignment, both horizontally and vertically. For example, if drawbar 53 is angularly displaced in the horizontal plane of FIG. 4, edge 71*a* of flange 57 contacts surface 69 of platform 25 and edge 71*b* of flange 55 contacts surface 69 of platform 23. Compressive force so transmitted will tend to urge the platform into alignment.

Similarly, and with reference to FIG. 5, if platforms 23, 25 are misaligned in the vertical direction, edge 71*c* of flange 57 will contact surface 69 of platform 25 and edge 71*d* of flange 55 will contact surface 69 of platform 23. Again compressive forces experienced under buff loading will impart corrective loading upon the platforms through the drawbar causing the separate elements to seek an aligned relationship.

A modified form of coupling construction between adjacent decks is shown in FIGS. 6–14. In this version, the rigid stop block 65 on each platform is replaced by typical draft gear 101 mounted in a frame 107 fixed to decks 23, 25. Each draft gear includes a rigid plate 109*a* and a rigid plate 109*b* and an intermediate compressive media 109*c* to absorb compressive shock in the usual manner. Plate 109*a* of each draft gear defines a face 109 which is equivalent to surface 69 in the embodiment of FIGS. 1–5.

In addition, the embodiment of FIGS. 6–14 includes a rigid drawbar 103 which is formed with elongated openings or slots 105. Each end of drawbar 103 includes a flange 112 defining a substantially flat face 111.

Figure 11:
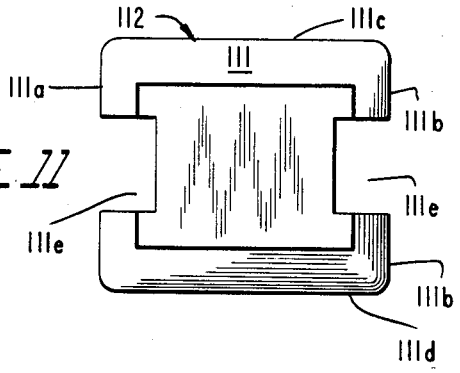
FIG. 11 is an end view of the drawbar of FIGS. 6 and 7.

As in the embodiment of FIGS. 1–5, and as best seen in FIG. 11, each face 111 includes a pair of vertical edges 111*a* and 111*b* and a pair of horizontal edges 111*c* and 111*d*. Edges 111*a* and 111*b* are discontinuous due to the presence of cut outs at 111*e* in the flanged ends. This is of course optional and flanges 111 could be completely rectangular.

As was the case in the embodiment of FIGS. 1–5, when the car is being pushed, the confronting faces 109 of the draft gear of platforms 23, 25 engage end surfaces 111 and the drawbar 103 is in compression.

When the car is being pulled, the drawbar 103 is in tension and force is transmitted to the deck 25 through a draft key 73 engaged in each of slots 105. As can be appreciated, any number of platforms may be included in this modified form of car. Each would be constructed as previously described and would include single axle trucks.

Figure 12:
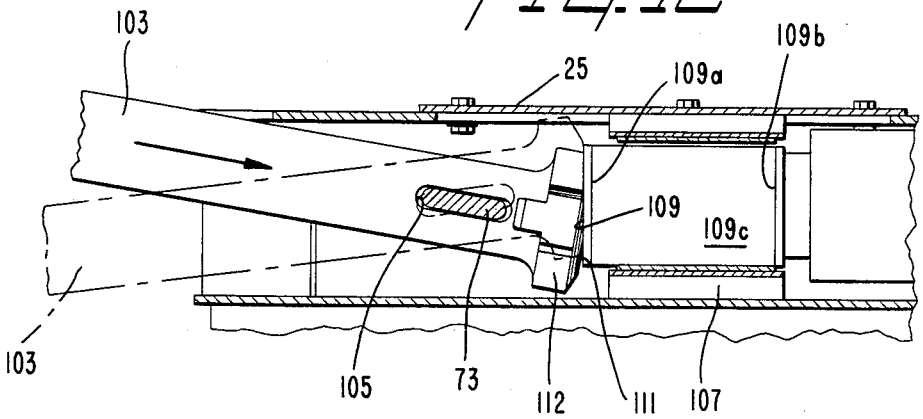
FIG. 12 is a view similar to FIG. 9 showing the parts in position for maximum vertical articulation when the car is being pushed.
Figure 13:
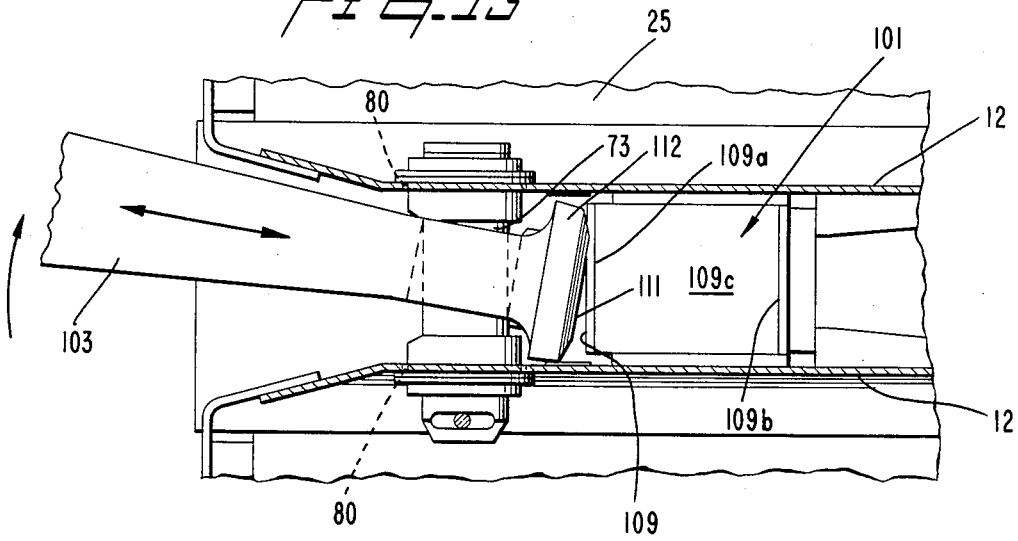
FIG. 13 is a view similar to FIG. 8 and showing the parts in position during a maximum horizontal articulation of adjacent decks.
Figure 14:
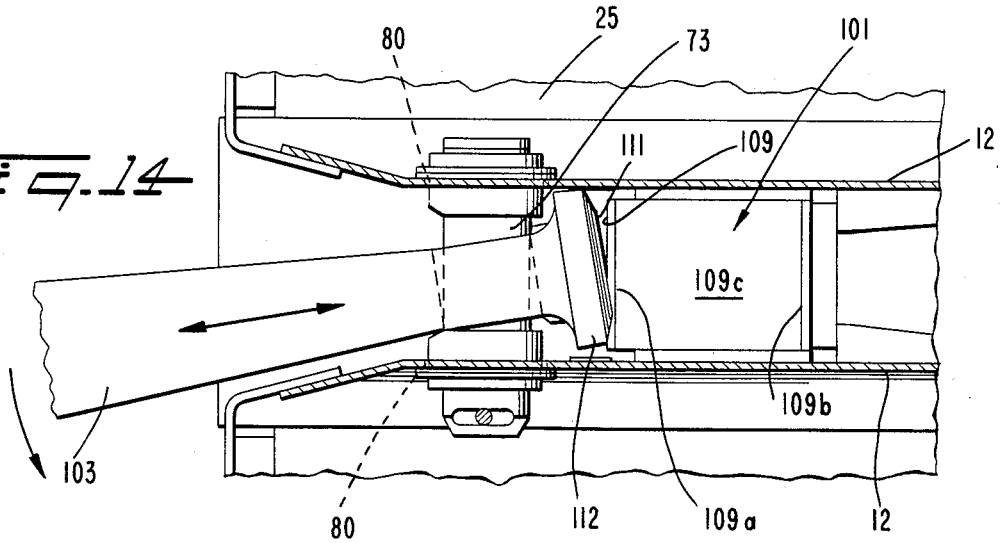
FIG. 14 is a view similar to FIG. 13 showing the parts in the opposite extreme position during horizontal articulation of adjacent decks.

As in the embodiment of FIGS. 1–5, the drawbar 103 can pivot or rock in both horizontal and vertical directions allowing relative movement between platforms in these directions. Relative movement between the drawbar 103 and the deck 25 in the horizontal direction during horizontal articulation of adjacent decks is illustrated in FIGS. 13 and 14. It is limited by engagement between the drawbar 103 at opening 105 and the draft key 73, about 11° in each direction. Relative movement of the parts during vertical articulation of the car decks is illustrated in FIG. 12 and is limited by engagement between the drawbar 103 and the draft key 73, about 15° in each direction.

Figure 8:
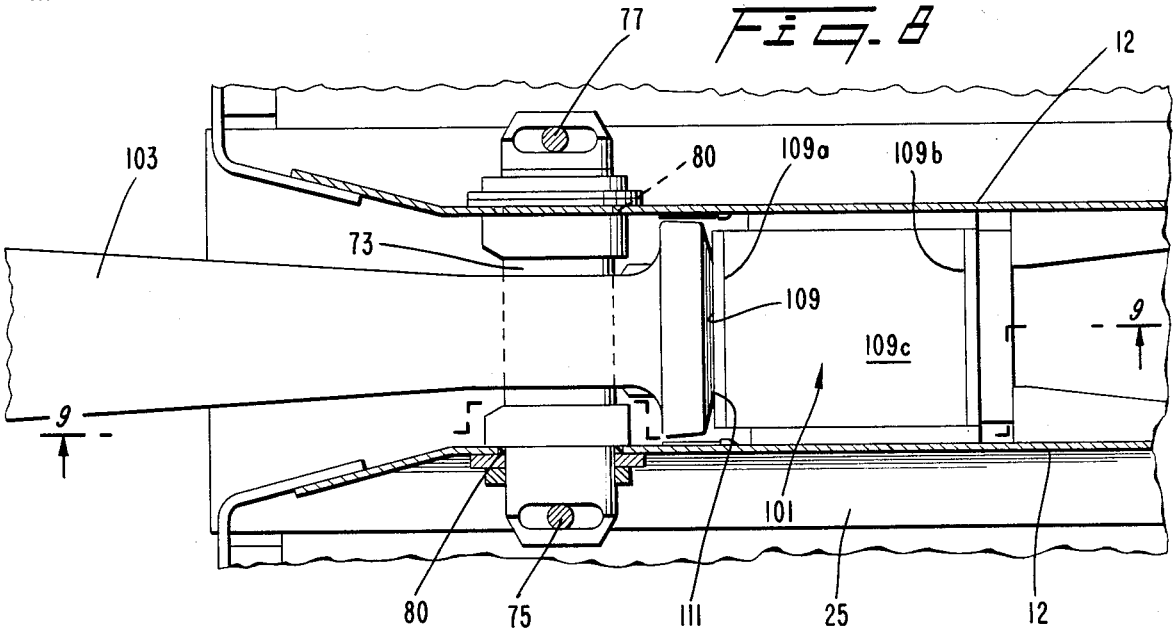
FIG. 8 is a view similar to FIG. 4 showing the modified drawbar in place in a modified deck construction.
Figure 9:
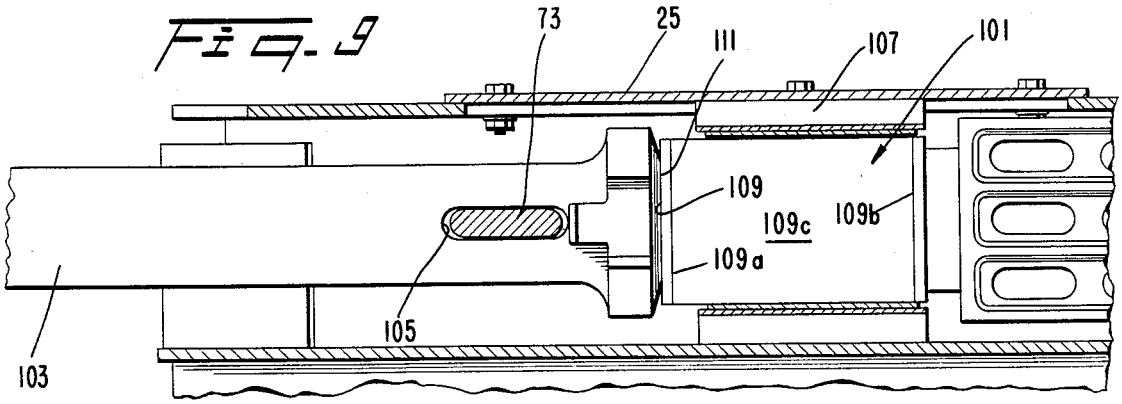
FIG. 9 is a sectional view of the structure of FIG. 8 taken along the line 9—9 thereof.

In accordance with the invention, the drawbar and decks are formed with cooperable and engageable surfaces which are operable to resist skewing of the decks when the car is being pushed. This greatly reduces or eliminates the tendency of the decks to jackknife and the car to derail. As embodied herein, and described above, the drawbar 103 has a substantially flat face 111 which confronts a substantially flat face 109 on the draft gear 101 of adjacent platforms 23, 25. When the platforms are aligned with one another and the car is being pushed, the parts are in position as shown in FIGS. 8 and 9 so that the faces 109, 111 are substantially parallel and engaged as shown. They assume non-parallel relationship when the platforms are horizontally pivoted with respect to each other and when the platforms are vertically misaligned.

When the decks 23, 25 are misaligned or skewed such as when negotiating a curve in the track, the drawbar 103 will, as described above, pivot relative to the decks. The maximum allowable pivotal or rocking movement of the drawbar 103 relative to the deck 25 when the cars are being pushed is illustrated in FIGS. 13 and 14. In FIG. 13, the drawbar 103 has pivoted or rocked in a clockwise direction relative to the deck 25. In FIG. 14, the drawbar is pivoted or rocked in the counter-clockwise direction. If uncontrolled, these conditions could cause the platforms to jackknife. However, as shown in FIGS. 13 and 14, the faces 111 on the drawbar 103 engage with the faces 109 on the draft gears 101 only at one or the other outer edges of the flanges. For example, and with reference to FIGS. 11 and 14, the edge 111*a* of one flange 111 contacts surface 109 of draft gear 101 on the illustrated platform 25, and the edge 111*b* of the opposite flange of draft gear 103 contacts the surface 109 of the draft gear on the other platform 23. When misaligned in the opposite direction, as shown in FIG. 13, edge 111*b* of flange 111 contacts surface 109 of draft gear 101 on platform 25 and edge 111*a* of the opposite flange 111 of drawbar 103 contacts surface 109 of draft gear 101 on platform 23. This engagement imparts a reaction force on the drawbar 103 and platforms 23, 25 tending to pivot them toward an aligned position. This force opposes the force developed on the drawbar by the pushing action of the car and thereby resists the tendency of the decks to jackknife, forcing them toward a realigned relationship.

In a similar fashion, when the car is being pushed and the decks 23, 25 are aligned with one another, the face 111 on the drawbar is substantially parallel to the face 109 on the block 101 as shown in FIGS. 8 and 9. However, when the decks 23, 25 are misaligned, such as when they are unequally loaded or one deck is loaded and the other is not, the drawbar 103 is angled upwardly or downwardly relative to deck 25 as seen in FIG. 12. In these positions, the faces 109, 111 are not parallel but engage one another only at the top or the bottom edges as shown.

Referring to FIGS. 11 and 12, when platform 23 is above platform 25 and drawbar 103 is vertically misaligned, as shown in solid lines in FIG. 12, edge 111*c* at flange 111 contacts surface 109 of draft gear 101 on platform 25 and edge 111*d* of the opposite flange 111 contacts surface 109 of draft gear 101 on platform 23. When the unequal heights of platforms 23, 25 are reversed, as shown in dotted lines in FIG. 12, the respective edge contacts of flanges 111 are also reversed. The compressive forces thus transmitted in buff loading urge the platforms and drawbar toward an aligned relation, thus reducing or eliminating any tendency to lift trucks 35, 37 off the track, which would result in a derailment. This is especially important when platforms 23, 25 are of lightweight construction as in the aforementioned U.S. Pat. No. 4,339,996.

As in the earlier embodiment, a draft key 73 extends through slots 105 at each end of drawbar 103. Each such key is connected to one of the platforms 23, 25 to secure the drawbar to the platform. It serves as the means through which traction forces are transferred from the drawbar to the central spines as the cars are being pulled.

Bolts 75, 77 retain the coupler pin to the respective platform. However, traction forces are transferred directly to central spine 10 through contact of the pin 73 with appropriate openings 80 formed in the spine members. It should be noted that sufficient flexibility exists in the connection to the central spine and in the clearance between the slots 105 and outer periphery of the keys 73 to permit vertical misalignment of adjacent platforms as illustrated in FIG. 12.

When in tension, the respective platforms and connecting drawbars tend to align, and additional compensating features are not necessary.

It will be apparent to those skilled in the art that various additions, substitutions, modifications and omissions may be made to the construction of the present invention without departing from the scope or spirit of the invention. Thus, it is intended that the present invention cover the additions, substitutions, modifications and omissions of this invention provided they come within the scope of the appended claims and their equivalents.

What is claimed is:

1. An articulated railroad car for transporting wheeled vehicular trailers comprising at least two platforms having forward and rearward ends, a wheeled truck at the forward and rearward end of each platform, said trucks each including only two wheels joined by a single axle and a frame supporting said platform, disengageable couplings at the forward end of the first one of said platform and at the rearward end of the last of said platforms, respectively, and a semi-permanent coupling connecting the rearward end of said first platform to the forward end of the adjoining platform, said coupling including a rigid drawbar engageable with means at the rearward end of said one platform and at the forward end of said adjacent platform to transmit pushing and pulling forces therebetween, said drawbar allowing relative movement between said platform in both horizontal and vertical directions, said drawbar having enlarged flanges defining substantially flat faces at opposite ends, said platforms each having means fixed thereto having flat faces confronting said drawbar flat faces and engageable therewith when said car is being pushed.

2. The device claimed in claim 1, said drawbar having openings therethrough adjacent said opposite ends and each said platform defining a central spine defining slots having a draft key removably fixed therein extending through one of said openings, said drawbar engaging said draft keys and said draft keys engaging said spines within said slots therein during draft loading.

3. The improvement as claimed in claim 2 wherein said means fixed to said platforms include a compressible draft gear.

4. The device claimed in claim 1, wherein said drawbar flanges having said flat faces define at least pairs of vertically extending edges with said drawbar arranged with respect to said platforms such that when said platforms are horizontally pivoted with respect to each other one vertical edge of said pair at one end of said drawbar contacts said flat face on one of said platforms and the opposite vertical edge of said pair at the other end of said drawbar contacts said flat face on the other of said platforms.

5. The device claimed in claim 4, wherein said drawbar flanges having said flat faces define at least pairs of horizontally extending edges with said drawbar arranged with respect to said platforms such that when said platforms are vertically misaligned one horizontal edge of said pair at one end of said drawbar contacts said flat face on one of said platforms and the opposite horizontal edge of said pair at the other end of said drawbar contacts said flat face on the other of said platforms.

6. The device claimed in claim 1, wherein said drawbar flanges having said flat faces define at least pairs of horizontally extending edges with said drawbar arranged with respect to said platforms such that when said platforms are vertically misaligned one horizontal edge of said pair at one end of said drawbar contacts said flat face on one of said platforms and the opposite horizontal edge of said pair at the other end of said drawbar contacts said flat face on the other of said platforms.

7. The improvement as claimed in claim 1 wherein said means fixed to said platforms includes a rigid, substantially nonelastic member.

8. In an articulated railroad car which includes at least two platforms having wheel trucks at the forward and rearwards ends of each platform, the improvement which comprises a rigid drawbar interconnecting the rearward end of one said platform and the forward end of an adjoining platform to transmit pushing and pulling forces therebetween, said drawbar and said platforms being formed to allow relative movement between said platforms in both horizontal and vertical directions and having cooperable and engageable surfaces which during buff loading impact forces urging said platforms and drawbars into alignment, said drawbar having enlarged flanges defining substantially flat faces at opposite ends thereof, said platforms having means fixed thereto presenting substantially flat faces in confronting relation to said drawbar flat faces and engaged therewith when said car is in buff loading, said flat faces on said drawbar and said flat faces on said means fixed to said platforms being parallel when said platforms are aligned and being non-parallel when said platforms are pivoted in the horizontal direction or vertically misaligned and operable in buff to resist jackknifing and derailment of said car body.

9. The improvement as claimed in claim 8, said drawbar having through openings adjacent to each end, and each said platform defining a central spine defining slots having a draft key removably fixed therein and extending through one of said openings, said drawbar engaging said draft keys and said draft keys engaging said spines within said slots therein during draft loading.

10. The improvement as claimed in claim 9, said means fixed to said platforms include a compressible draft gear.

11. The improvement as claimed in claim 8, said means fixed to said platforms includes a rigid, substantially nonelastic member.

12. The improvement as claimed in claim 8, wherein said drawbar flanges having said flat faces define at least pairs of vertically extending edges with said drawbar arranged with respect to said platforms such that when said platforms are horizontally pivoted with respect to each other one vertical edge of said pair at one end of said drawbar contacts said flat face on one of said platforms and the opposite vertical edge of said pair at the other end of said drawbar contacts said flat face on the other of said platforms.

13. The improvement as claimed in claim 12, wherein said drawbar flanges having said flat faces define at least pairs of horizontally extending edges with said drawbar arranged with respect to said platforms such that when said platforms are vertically misaligned one horizontal edge of said pair at one end of said drawbar contacts said flat face on one of said platforms and the opposite horizontal edge of said pair at the other end of said drawbar contacts said flat face on the other of said platforms.

14. The improvement as claimed in claim 8, wherein said drawbar flanges having said flat faces define at least pairs of horizontally extending edges with said drawbar arranged with respect to said platforms such that when said platforms are vertically misaligned one horizontal edge of said pair at one end of said drawbar contacts said flat face on one of said platforms and the opposite horizontal edge of said pair at the other end of said drawbar contacts said flat face on the other of said platforms.

* * * * *